US005615752A

United States Patent [19]

Wassil

[11] Patent Number: 5,615,752

[45] Date of Patent: Apr. 1, 1997

[54] LADDER-LEVELING PLATFORM ASSEMBLY

[76] Inventor: Leonard Wassil, 4 Polk Pl., Vernon, N.J. 07462

[21] Appl. No.: 578,358

[22] Filed: Dec. 26, 1995

[51] Int. Cl.[6] ..... E06C 7/44

[52] U.S. Cl. ..... 182/200; 182/107

[58] Field of Search ..... 182/200–205, 182/107; 248/371, 396

[56] References Cited

U.S. PATENT DOCUMENTS

| | | | |
|---|---|---|---|
| 1,181,224 | 5/1916 | Jaeger | 248/396 |
| 5,005,669 | 4/1991 | Umebara | 248/397 X |
| 5,141,196 | 8/1992 | Arnold | 248/397 |
| 5,372,347 | 12/1994 | Minnich | 248/371 |

FOREIGN PATENT DOCUMENTS

| | | | |
|---|---|---|---|
| 337341 | 5/1921 | Germany | 182/201 |
| 2186903 | 8/1987 | United Kingdom | 182/204 |
| 2232710 | 12/1990 | United Kingdom | 182/200 |

*Primary Examiner*—Alvin C. Chin-Shue
*Attorney, Agent, or Firm*—Bernard J. Murphy

[57] ABSTRACT

A base, supported on a platform, has a plate pivotably coupled therein, and side walls of the base are apertured to receive rods. The rods maintain the plate in a selected inclination, as they are fitted through the apertures and hold the plate in position. The plate receives one upright of a ladder, in order to make the upright level with the other upright of the ladder on pitched ground, or uneven bearing surfaces, in which the two uprights cannot otherwise bear on a common-level surface.

6 Claims, 2 Drawing Sheets

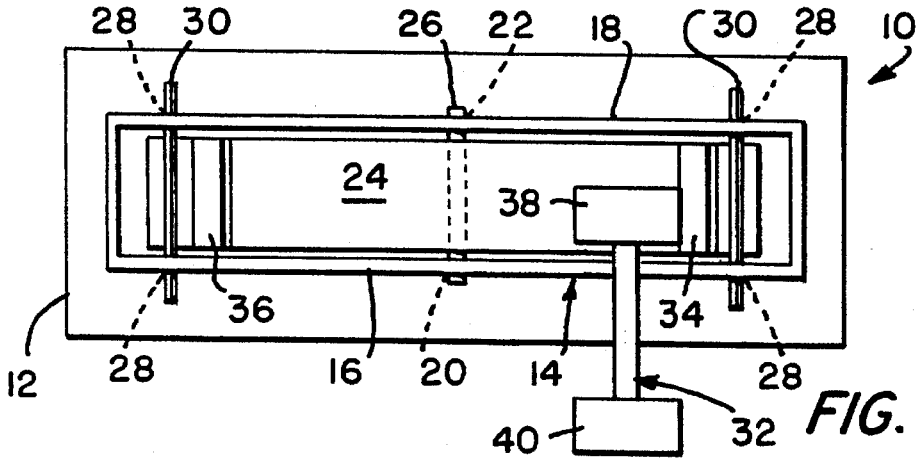
FIG. 2
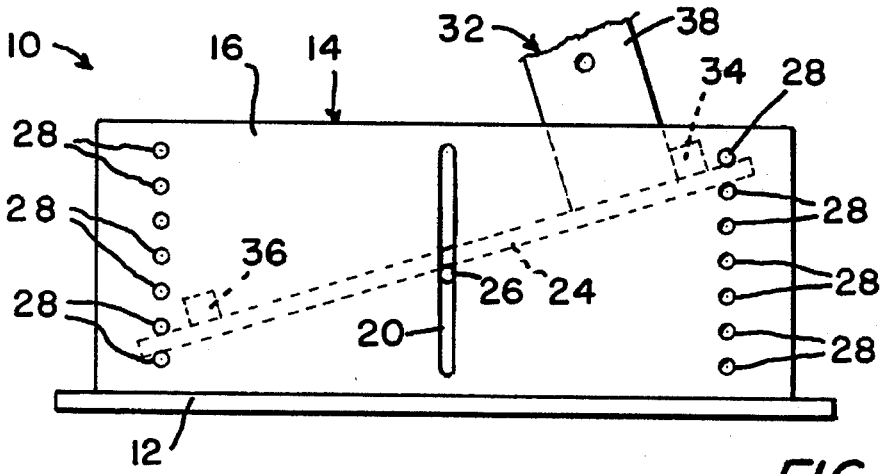
FIG. 1
FIG. 4
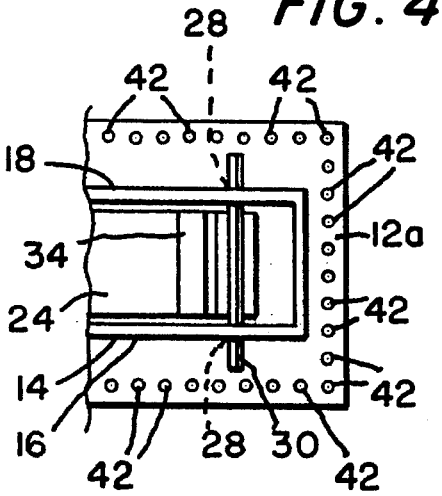
FIG. 3
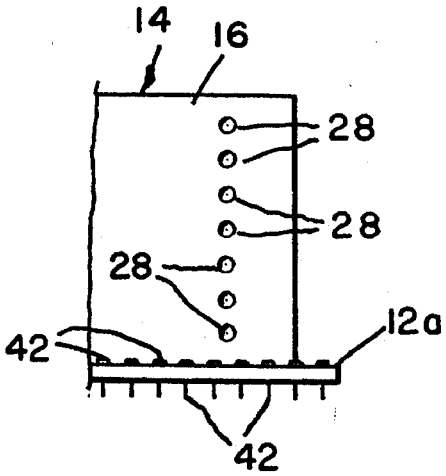

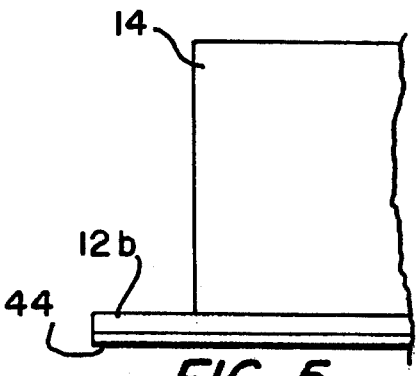
FIG. 5
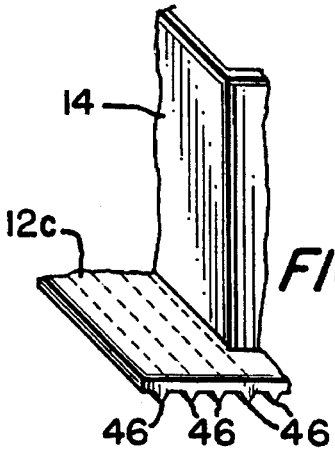
FIG. 6
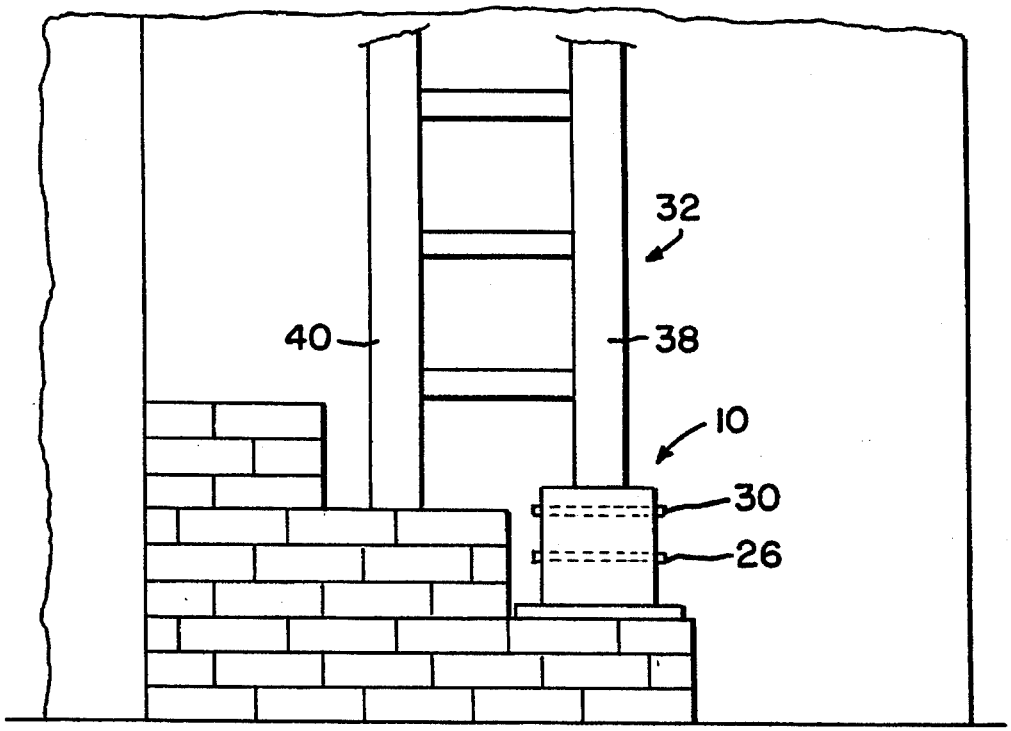
FIG. 7
FIG. 8
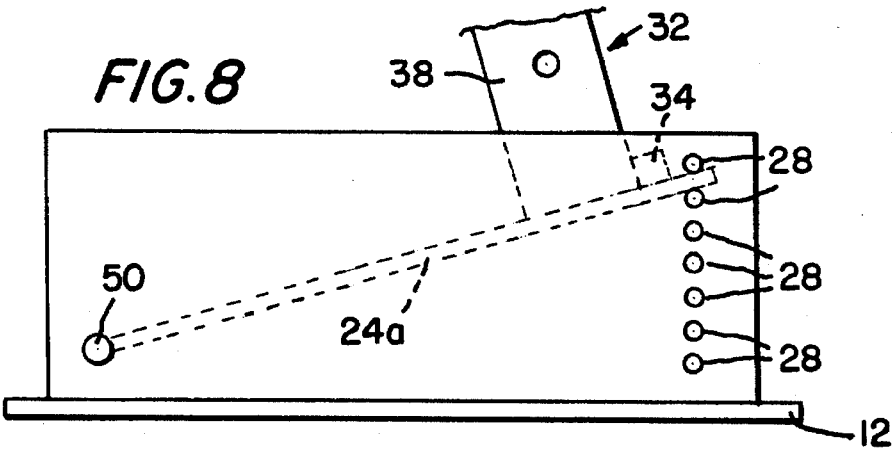

LADDER-LEVELING PLATFORM ASSEMBLY

This invention pertains to ladder leveling devices, and in particular to a ladder-leveling platform assembly of inexpensive construction, facile adjustment, and efficiency.

Ladder leveling devices are well known in the prior art, and exemplary thereof are the U.S. Pat. No. 2,205,935, issued to N. E. Stenroos, on Jun. 25, 1940, for a Leveling Attachment for ladders, and U.S. Pat. No. 4,243,122, issued on Jan. 6, 1981 to I. B. Coutts, for a Ladder Leveling Device. The concept disclosed by patentee Stenroos is commendable, however, it will not accept any ladder; rather, a ladder has to be prepared, beforehand, to be used with the patented arrangement. The leg bottoms have to have V-shaped cutouts formed therein, and then special plates have to be fastened in place in the leg bottoms. As for the Device set forth by patentee Coutts, it appears to be expensive of manufacture. Too, is looks like it has a high center of gravity and, possibly, would be susceptible to falling over.

What has been needed, in this technology, is a ladder-leveling means which will accept any ladder, including ladders which have swivels at the bottom, and such means which offer simple manufacture and stability and security in use.

It is an object of this invention to set forth just such a long sought, improved, ladder-leveling means. Particularly, it is an object of this invention to disclose a ladder-leveling platform assembly, comprising a platform; a base supported on said platform; and a plate within said base; wherein said base has a pair of slots formed therein; said plate has an axle; ends of said axle are slidably engaged with said slots; and said base has series of apertures, formed therein, for receiving rods therethrough for selectively adjusting a disposition of said plate.

Further objects of this invention, as well as the novel features thereof, will become apparent by reference to the following description, taken in conjunction with the accompanying figures, in which:

FIG. 1 is a side elevational view of the Ladder-Leveling platform assembly, according to an embodiment of the invention;

FIG. 2 is a plan view of the assembly of FIG. 1;

FIGS. 3 and 4 are elevational and plan views of portions of an end of the platform, showing an alternative embodiment of the platform;

FIG. 5 is a side elevational view of a portion of an end of the platform, again, showing another alternative embodiment of the platform;

FIG. 6 is a perspective view of a platform end illustrating yet another embodiment thereof;

FIG. 7 depicts the assembly in use with brick steps;

FIG. 8 is a side view of an alternative platform assembly, according to the invention.

As shown in FIGS. 1 and 2, the novel ladder-leveling platform assembly 10 comprises a flat platform 12 having a rectangular, walled base 14 centrally located and supported thereon and secured thereto by hardware (not shown). Side walls 16 and 18 of the base 14 have slots 20 and 22 formed therein, the slots being in alignment with each other across the base 14. A flat, thin rectangular plate 24, having an axle 26 integral therewith, is fully confined within the base 14, and the ends of the axle 26 are slidably engaged with the slots 20 and 22.

Adjacent ends of the walls 16 and 18 are series of apertures 28, substantially equally spaced apart, in vertical array. These apertures 28 are provided for receiving therethrough rods 30, two of such rods 30 being shown in FIG. 2.

With the axle 26 engaged with the slots 20 and 22, and rods 30 inserted through given ones of the apertures 28, the plate 24 can be caused to assume a desired angle to compensate for the pitched or raised condition of whatever is the bearing surface upon which the platform is emplaced. As shown in FIG. 1, plate 24 of the assembly 10 is depicted as tilted at approximately twenty degrees of arc. Accordingly, with the platform set upon a bearing surface, i.e., the ground, a roof, or such, which has a twenty-degree pitch, the ladder 32 will be supported in a truly vertical disposition. As can be appreciated, the plate 24, and consequently the ladder 32, can be leveled on any bearing surface which is raised or inclines right or left, by setting the rods 30 to compensate for the inclination. Too, the ladder is secure in the base 14; abutment blocks 34 and 36 are fastened to the plate 24 and, as can be seen, one of the ladder uprights 38 and 40, namely upright 38, is set against block 34, the block 34 confrontingly engages only an outermost, and lowermost, side portion of the upright 38. Upright 40 is set upon a bearing surface of some sort, i,e., a knoll or hummock, or such which requires the elevation of upright 38, so that the ladder can rise vertically.

The base 14 is shown as having a given height. It is simply a matter of choice to provide for a taller base, if warranted, to enable for ladder leveling through. more than twenty degrees of arc. A taller base, of course, would provide for more apertures 28, and a more upwardly-extended pair of slots 20 and 22, so that one of the uprights could be elevated to a greater height. Such is a manufacturing and marketing consideration. The slots 20 and 22, of course are readily cooperative with the axle 26, and the apertures 28 and rods 30, for elevating the plate 24, or lowering the plate 24, within the base 14, if such would be desirable.

The inventive assembly 10, of course can find especial utility on a pitched roof, and to provide for a sure gripping of the platform 12 in such circumstances, an alternative platform **12*a* is depicted in FIGS. 3 and 4. Here, nails 42 are fastened to the platform 12*a*, about the periphery of an end thereof, to have the pointed nail ends project from the underside of the platform 12*a***.

Another alternative platform **12*b*, shown only in part in FIG. 5, has a sheet of rubberized material 44 fixed to the bottom thereof, again to provide for gripping engagement with a bearing surface upon which the platform 12*b* is placed. Finally, another platform 12*c*, shown in part in FIG. 6, has a pattern of ribs 46**, of triangular cross-section, in traverse of the underside thereof, to offer more stability and gripping surety.

FIG. 6 shows a ladder arranged for access to some elevated task where, unavoidably, the ladder bottom must be set upon brick steps. In the circumstances, upright 40 can be set upon the second step but, of course, upright 38 would require elevation so that the ladder can be set level. The assembly 10, then, is emplaced, lengthwise, along the first step with the plate 24 pitched to give upright 38 the necessary elevation to match that of upright 40.

The assembly 10, as depicted and described, has the plate 24 joined to an axle 26, and with the series of apertures 28, can be inclined in one attitude or the alternative attitude, to elevate a ladder upright. FIG. 8 shows an alternative assembly **10*a* in which the plate 24*a* is simply pivoted at one end, at 50, and the side walls have only one vertical array of apertures 28. This may be a simpler manufacture which affords no less utility, as one can turn the assembly end for end to present the elevating end of the plate 24*a* where needed to elevate a ladder upright. In each embodiment of the invention (FIGS. 1 and 8), the platform 12, as FIGS. 2 and 4 establish, has a width and length greater than those aspects of the base 14 centrally supported on the platform. Consequently, portions of the platform 12, which are laterally outreaching from the base 14, comprise outrigger means for providing lateral stability for said base, and to resist any tipping over of said assembly 10**.

While I have described my invention in connection with specific embodiments thereof, it is robe clearly understood that this is done only byway of example, and not as a limitation to the scope of the invention, as set forth in the objects thereof, and in the appended claims.

What is claimed is:

1. A ladder-leveling platform assembly, comprising:

a platform; and a base centrally located and supported on said platform; wherein said base has a pair of parallel, side walls; and a plate fully confined within said base;

means engaging said plate and said side walls for accommodating a selected inclination of said plate; and said base has a series of apertures, formed therein, for receiving rods therethrough for maintaining said plate at a selected inclination; wherein said plate comprises only a flat, thin element having (a) an axle, and (b) means fastened to said element for confrontingly engaging only an outermost and lowermost, side portion of a ladder upright;

said platform comprises outrigger means for providing lateral stability for said base and assembly to resist any tipping over of said assembly; wherein said outrigger means comprises lateral portions of said platform which outreach from said base and define said platform with a width which is greater than said base.

2. A ladder-leveling platform assembly, according to claim 1, wherein:

said side walls have slots formed therein;

ends of said axle are slidably engaged with said slots; and said slots and said axle comprise means cooperative for (a) elevating said plate, and (b) lowering said plate within said base.

3. A ladder-leveling platform assembly, according to claim 1, wherein:

said apertures are formed in said walls in adjacency to opposite ends of said walls.

4. A ladder-leveling platform assembly, according to claim 1, wherein:

said upright-engaging means comprises at least one block coupled to, and extending across, said plate.

5. A ladder-leveling platform assembly, according to claim 1, wherein:

an end of said plate is pivotably coupled to said side walls.

6. A ladder-leveling platform assembly, according to claim 1, wherein:

said platform has an underlying surface for setting upon a bearing surface; and said underlying surface has means for frictionally gripping a bearing surface.

* * * * *